US007448473B2

(12) United States Patent
Lindberg et al.

(10) Patent No.: US 7,448,473 B2
(45) Date of Patent: Nov. 11, 2008

(54) REMOTE CONTROL OF AN ELEVATOR AND FAST RECOVERY FROM OPERATIONAL SHUTDOWN SITUATIONS EXECUTED FROM A REMOTE TERMINAL

(75) Inventors: Jukka Lindberg, Riihimäki (FI); Ari-Pekka Hietala, Hyvinkää (FI); Pekka Perälä, Kerava (FI); Gabriella Still, Helsinki (FI)

(73) Assignee: KONE Corporation, Helsinki (FI)

( * ) Notice: Subject to any disclaimer, the term of this patent is extended or adjusted under 35 U.S.C. 154(b) by 0 days.

(21) Appl. No.: 11/790,645

(22) Filed: Apr. 26, 2007

(65) Prior Publication Data

US 2007/0261924 A1 Nov. 15, 2007

Related U.S. Application Data

(63) Continuation of application No. PCT/FI2005/000458, filed on Oct. 26, 2005.

(30) Foreign Application Priority Data

Nov. 1, 2004 (FI) ..... 20041402

(51) Int. Cl.
*B66B 1/34* (2006.01)

(52) U.S. Cl. ..... 187/392; 187/384

(58) Field of Classification Search ..... 187/300, 187/306, 313, 314, 316, 317, 380–389, 391–396, 187/413; 340/539.1, 539.16, 539.17
See application file for complete search history.

(56) References Cited

U.S. PATENT DOCUMENTS 3,973,648 A * 8/1976 Hummert et al. ..... 187/393
5,258,586 A 11/1993 Suzuki et al.
6,050,369 A * 4/2000 Leone et al. ..... 187/392
6,364,066 B1 4/2002 Bolch et al.
6,847,292 B2 * 1/2005 Nlabu ..... 340/539.1
7,073,633 B2 * 7/2006 Weinberger et al. ..... 187/393
2004/0154873 A1 8/2004 Curzon et al.
2004/0231929 A1 11/2004 Sasaki et al.

FOREIGN PATENT DOCUMENTS

EP 1 316 525 A1 6/2003
GB 2 267 977 A 12/1993
JP 10-93955 A 4/1998
JP 10-109836 A 4/1998
JP 2003-192248 A 7/2003
JP 2004-59260 A 2/2004
JP 2004-83158 A 3/2004
WO WO-01/81226 A1 11/2001

* cited by examiner

*Primary Examiner*—Jonathan Salata
(74) *Attorney, Agent, or Firm*—Birch, Stewart, Kolasch & Birch, LLP

(57) ABSTRACT

The invention relates to a method and a system for executing elevator control actions from a remote terminal in a remote control system. The remote control system comprises a remote terminal, one or more monitoring cameras as well as interface and data transfer means for the transmission of camera information, elevator status data and/or control commands between the elevator and the remote control system. The monitoring cameras are so directed that their combined image area substantially covers the operating area of the elevator. The remote terminal comprises a display device for the display of image information and elevator status data and means for starting elevator control functions. In the method, the operating area of the elevator is imaged by a monitoring camera or cameras, whose image information as well as the elevator status information is displayed on the display device of the remote terminal. Based on the image information and/or elevator status data, the control action to be executed is selected and an estimation as to whether the control action involves a risk of injury is performed. If no risk of injury exists, then the execution of the control action is started from the remote terminal.

20 Claims, 2 Drawing Sheets

Figure 1:
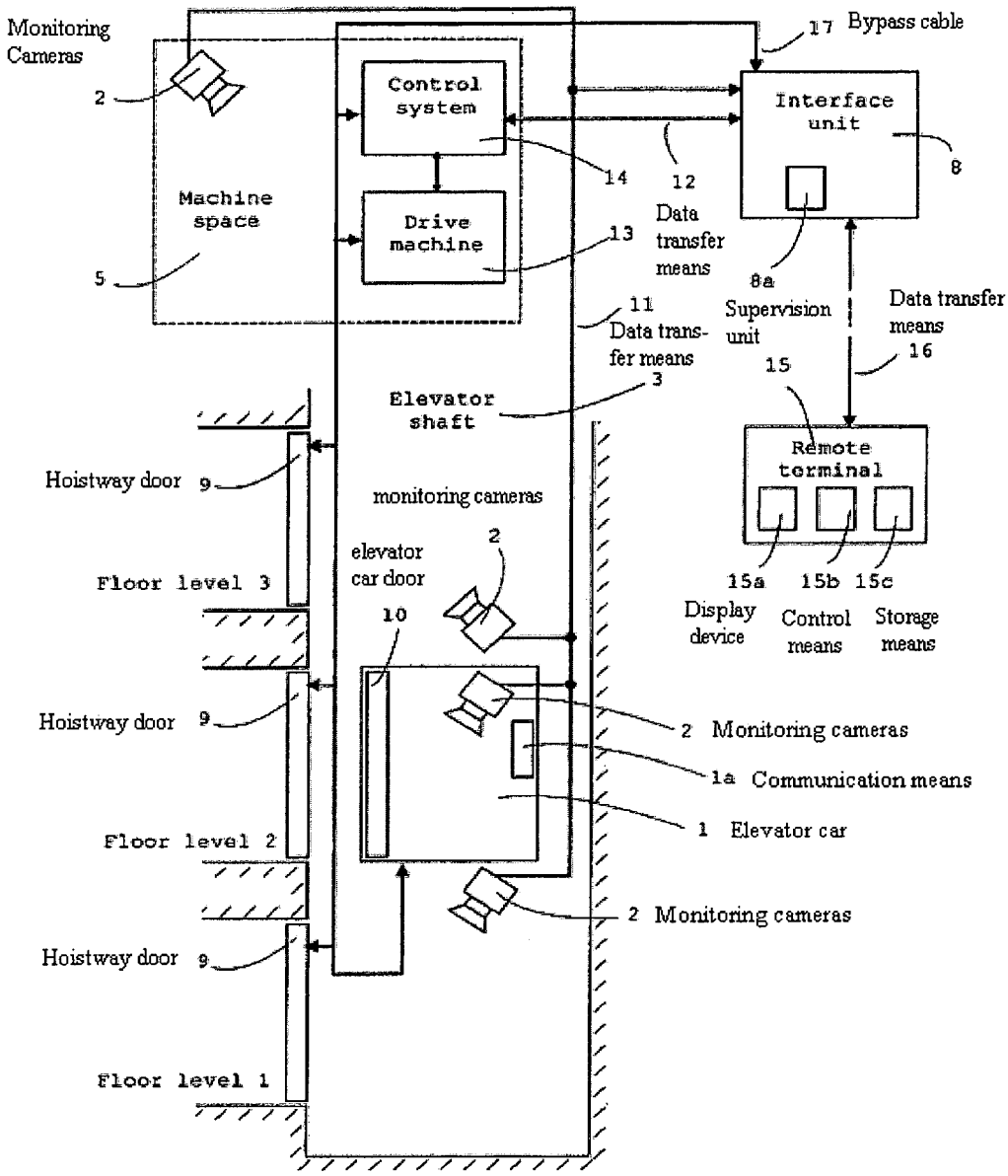

REMOTE CONTROL OF AN ELEVATOR AND FAST RECOVERY FROM OPERATIONAL SHUTDOWN SITUATIONS EXECUTED FROM A REMOTE TERMINAL

This application is a Continuation of copending PCT International Application No. PCT/FI2005/000458 filed on Oct. 26, 2005, which designated the United States, and on which priority is claimed under 35 U.S.C. §120. This application also claims priority under 35 U.S.C. §119(a) on patent application Ser. No(s). 20041402 filed in Finland on Nov. 1, 2004. The entire contents of each of the above documents is hereby incorporated by reference.

FIELD OF THE INVENTION

The present invention relates to a method for executing elevator control actions from a remote terminal in a remote control system. Furthermore, the invention relates to a remote control system comprising at least: a remote terminal; a number of monitoring cameras; and interface and data transfer means for the transmission of the image information of the monitoring cameras as well as elevator status data and/or control commands between the elevator and the remote terminal.

BACKGROUND OF THE INVENTION

Today's elevators are reliable and safe people movers. Unexpected failures or incidental interruptions of operation are rare and they are often caused by external disturbance factors, such as e.g. power failures, dirty sensors, frequently also by damage inflicted by hard impacts on mechanical structures of the elevator, such as e.g. doors. Although elevators generally do not cause an immediate risk of injury to elevator passengers or other people within the range of the elevator in the event of an operational shutdown, it is self-evident that in all situations passengers trapped in an elevator car have to be rescued as quickly as possible. However, elevator safety regulations require that the actions needed to allow the elevator to recover from a shutdown situation should be carried out safely without causing a risk of injury, which is why these actions may only be performed by authorized maintenance personnel. Typical shutdown situations are e.g. events where an elevator stops between floors, the door of an elevator car or a hoistway door does not open/close, or the elevator car does not start moving.

Often the monitoring of elevator operation is arranged in a centralized manner such that, from a single remote monitoring station, the operational state of a plurality of elevators generally located in the neighborhood is maintained and/or monitored. In their simplest form, remote monitoring stations are monitoring stations that take care of the reception and transmission of elevator alarms, or in their more advanced form monitoring stations that also take care of elevator condition monitoring and elevator surveillance. In situations of operational shutdown of an elevator, an alarm is transmitted to the remote monitoring station either automatically as an alarm activated by the elevator control system and/or manually, e.g. as an emergency call entered by an elevator passenger from inside the elevator car. Upon being notified about the operational shutdown of the elevator, the monitoring staff calls approved maintenance personnel to the place of alarm in accordance with the alarm request. The duty of the authorized maintenance personnel is to rescue all passengers trapped in the elevator car safely out of the car and to restore the elevator to the normal state of operation. This is often implemented by moving the elevator car to the nearest floor level with one or more of the elevator safety circuits bypassed (shunted).

A problem with monitoring arranged via a remote monitoring station is that in operational shutdown situations it may take unreasonably long for the maintenance personnel to reach the place of alarm, depending e.g. on the availability of maintenance personnel and their location relative to the place of alarm, smoothness of traffic in the area at different times of the day and many other external circumstances. Also, regional problem situations, such as widespread power failures, even earthquakes, may cause congestion in the transmission of maintenance requests and thus result in elevator passengers remaining trapped and waiting in elevator cars even for several hours before getting out. Some of the passengers may experience anxiety and/or stress if they have to wait long to get out. There also occur catastrophes, e.g. fires and/or earthquakes, where trapped passengers are in mortal peril and therefore have to be rescued as quickly as possible out of the elevator car.

Another problem is that an interruption of elevator operation may be caused by a minor and/or incidental fault that results in an operational shutdown situation that only requires a very simple maintenance action for the elevator to recover, but nevertheless authorized maintenance personnel have to be called to the site to correct the fault, as stipulated by the safety regulations. This results in extra maintenance visits, costs and unnecessarily long interruptions in normal elevator operation.

Prior art is described in U.S. patent specification Pat. No. 6,364,066, which discloses a system for rescuing elevator passengers from an elevator car in the event of operational shutdown of an elevator. In the solution disclosed, a check is made to ensure that control actions ordered from a remote control system do not involve a risk to the passengers in the elevator car before execution of the control actions. The disclosed solution is based on the use of, inter alia, on/off-type sensors monitoring the status of elevator car doors.

A problem with the prior-art solution is that it does not provide for comprehensive observation of the situation prevailing in the whole operating area of the elevator, but instead only aims at ensuring the safety of elevator passengers in the elevator car before remote control actions are executed. Therefore, for example the situation prevailing in the elevator shaft is not taken into account. Moreover, the use of on/off-type sensors for observing the status of operational elements, such as the status of doors, can easily lead to fatal errors if the sensors are defective and produce incorrect information about the actual state of the operational elements.

OBJECT OF THE INVENTION

The object of the present invention is to overcome the above-described drawbacks and to create a completely new type of solution for remote operation of elevators and fast recovery from operational shutdown situations. A further object of the invention is to accomplish at least one of the following objectives:

- prevent or at least preventively reduce interruptions of elevator operation caused by vandalism.
- improve personal safety for recovery from operational shutdown situations.
- promote faster recovery from large operational shutdown situations comprising a plurality of elevators.
- enable remote operation of a plurality of elevators from the same place.
- save human lives in catastrophe situations.

enable storage and subsequent analysis of events having taken place during operational shutdowns, for example to allow estimation of liabilities possibly related to rescue operations.

prevent danger situations arising from uncoordinated and simultaneous rescue operations executed from several different places.

eliminate or at least reduce the number of unnecessary maintenance visits to elevator sites.

BRIEF DESCRIPTION OF THE INVENTION

The method of the invention is characterized in that the method comprises the steps of imaging the operating area of the elevator by a number of monitoring cameras so that all persons present in the operating area of the elevator can be perceived from the image information of the monitoring cameras; displaying the image information of the camera or cameras as well as elevator status data on the display device of the remote terminal; selecting on the basis of the image information and/or elevator status data a control action to be executed; estimating on the basis of the image information and/or elevator status data whether the execution of the selected control action involves a risk of injury; and starting the execution of the control action from the remote terminal if the estimation thus made indicates that the control action involves no risk of injury. The remote control system of the invention is characterized in that the monitoring cameras are so directed that their combined image area substantially covers the operating area of the elevator; the remote terminal is provided with a display device for the display of image information and/or elevator status data; and the remote terminal contains means for starting elevator control functions.

Below are explanations of the meanings of certain terms used in the text:

Operating area of an elevator: This term refers to the spaces associated with the elevator, comprising the interior space of the elevator car, the elevator shaft, possible machine room, the spaces above and below the elevator car, including the door areas on the floor levels above and below the elevator car. The safety of persons present in these spaces has to be ensured before elevator control actions are started.

Risk of injury: This term refers to a situation defined by elevator safety regulations and/or other corresponding instructions during which certain control actions executed from a remote terminal of a remote control system may lead to injury to elevator passengers and/or other persons present within the operating area of the elevator.

Operator: This term refers to a person who uses a remote terminal of a remote elevator control system to perform elevator control actions.

RDF operation: This term refers to an elevator operating mode wherein one or more of the safety circuits of the elevator are bypassed.

Authentication: This term refers to different methods for identifying the operator (user of the system). Generally used identification methods are e.g. a user name in combination with a password, PIN codes and intelligent cards.

In the method of the invention, wherein elevator control actions are executed from a remote terminal of a remote control system, the operating area of the elevator is imaged by one or more monitoring cameras so that all persons present in the operating area of the elevator can be perceived from the image information. The image information provided by the camera or cameras as well as the elevator status information is displayed on the display device of the remote terminal. The control action to be executed is selected on the basis of the image information and/or elevator status data. Based on the image information and/or elevator status data, the risk of injury associated with the control action is estimated. Execution of the control action is started from the remote terminal if this estimation indicates that the control action involves no risk of injury.

The invention provides the advantage that elevator passengers can be rescued very quickly from an elevator car. There is no need to wait for the arrival of maintenance personnel, but the required actions for rescuing the elevator passengers and/or recovery of the elevator from the operational shutdown situation can be started immediately. The invention also makes it possible to achieve a better than ordinary personal safety level, because the operating area of the elevator can be monitored reliably and comprehensively by means of monitoring cameras from several points, if necessary even by using a plurality of cameras simultaneously. By applying the invention, it is possible to prevent situations where elevator control and/or rescue actions are performed in an uncoordinated manner and simultaneously from several locations, such as e.g. from the elevator machine room, from a floor level and/or from a remote terminal. The monitoring cameras can also be used to observe the operating area of the elevator in cases of catastrophe, such as fires and/or follow-up situations after earthquakes, when maintenance personnel may not be able to access the operating area of the elevator. According to the degree of seriousness of the situation prevailing in the elevator, the operator can immediately make an alarm and call e.g. the fire brigade or an ambulance to the place. In addition, the monitoring cameras can be used for overall safety control of the operating area of the elevator, thereby reducing interruptions of elevator operation due to e.g. vandalism. A further advantage of the invention is that a single operator can control several different elevators from the same remote terminal and thus accelerate recovery from large failure situations. In catastrophe situations, prompt help can save human lives.

In an embodiment of the method, the control actions are carried out in an operational shutdown situation of the elevator.

In an embodiment of the method, the execution of the control action is observed by the aid of the image information and/or elevator status data via the display device of the remote terminal during the execution of the control action. If a risk of injury is detected during the execution of the control action, then the execution of the control action is interrupted from the remote terminal.

In an embodiment of the method, the method includes selection of the monitoring cameras whose image information is displayed simultaneously on the display device of the remote terminal.

In an embodiment of the method, at least one of the elevator safety circuits is bypassed from a remote terminal of the remote control system.

In an embodiment of the method, the control actions are executed in order to rescue elevator passengers from an elevator car.

In an embodiment of the method, at least one of the following control actions are executed from the remote terminal: driving the elevator in normal mode to a floor level, stopping the elevator, opening/closing the landing door/elevator car door, opening/closing the brake of the elevator drive machine, operating the elevator in RDF mode.

In an embodiment of the method, the activation of one or more control actions executed from the remote terminal is only allowed via authentication and a secure data communication link.

In an embodiment of the method, the execution time of the control action started from the remote terminal of the remote control system is limited.

In an embodiment of the method, the image information of one or more monitoring cameras is transmitted, in addition to the remote terminal of the remote control system, also to a guarding post of the property containing the elevator.

In an embodiment of the method, two or more elevators can be controlled from one remote terminal.

In an embodiment of the method, the operating area of the elevator is illuminated to improve the image information.

In an embodiment of the method, the image information of one or more monitoring cameras is stored for subsequent analysis.

The remote elevator control system of the invention comprises a remote terminal, one or more monitoring cameras as well as interface and data transfer means for the transmission of elevator status data and/or control commands between the elevator and the remote control system. The monitoring cameras are so directed that their combined image area substantially covers the operating area of the elevator so as to allow all persons present in the operating area to be detected by the monitoring camera or cameras. The remote terminal is provided with a display device for the display of image information and/or elevator status data, and the remote terminal contains means for starting elevator control functions. The elevator status data include e.g. elevator position in the elevator shaft, "open/closed" data relating to elevator doors, and many other items of information indicative of the status of operating elements of the elevator.

In an embodiment of the remote control system, the remote control system additionally comprises means for bypassing at least one of the elevator safety circuits from the remote terminal.

In an embodiment of the remote control system, the system comprises means for limiting the execution time of control functions started from the remote terminal.

In an embodiment of the remote control system, the system comprises data transfer means for the transmission of the image information of one or more monitoring cameras to a guarding post of the property containing the elevator.

In an embodiment of the remote control system, the remote control system can be connected to two or more elevators.

In an embodiment of the remote control system, the system comprises means for illuminating the operating area of the elevator.

In an embodiment of the remote control system, the system additionally comprises means for storing the image information of one or more monitoring cameras.

LIST OF FIGURES

In the following, the invention will be described in detail with reference to a few embodiment examples and the attached drawings, wherein FIG. 1 represents a remote control system according to the invention.

Figure 2:
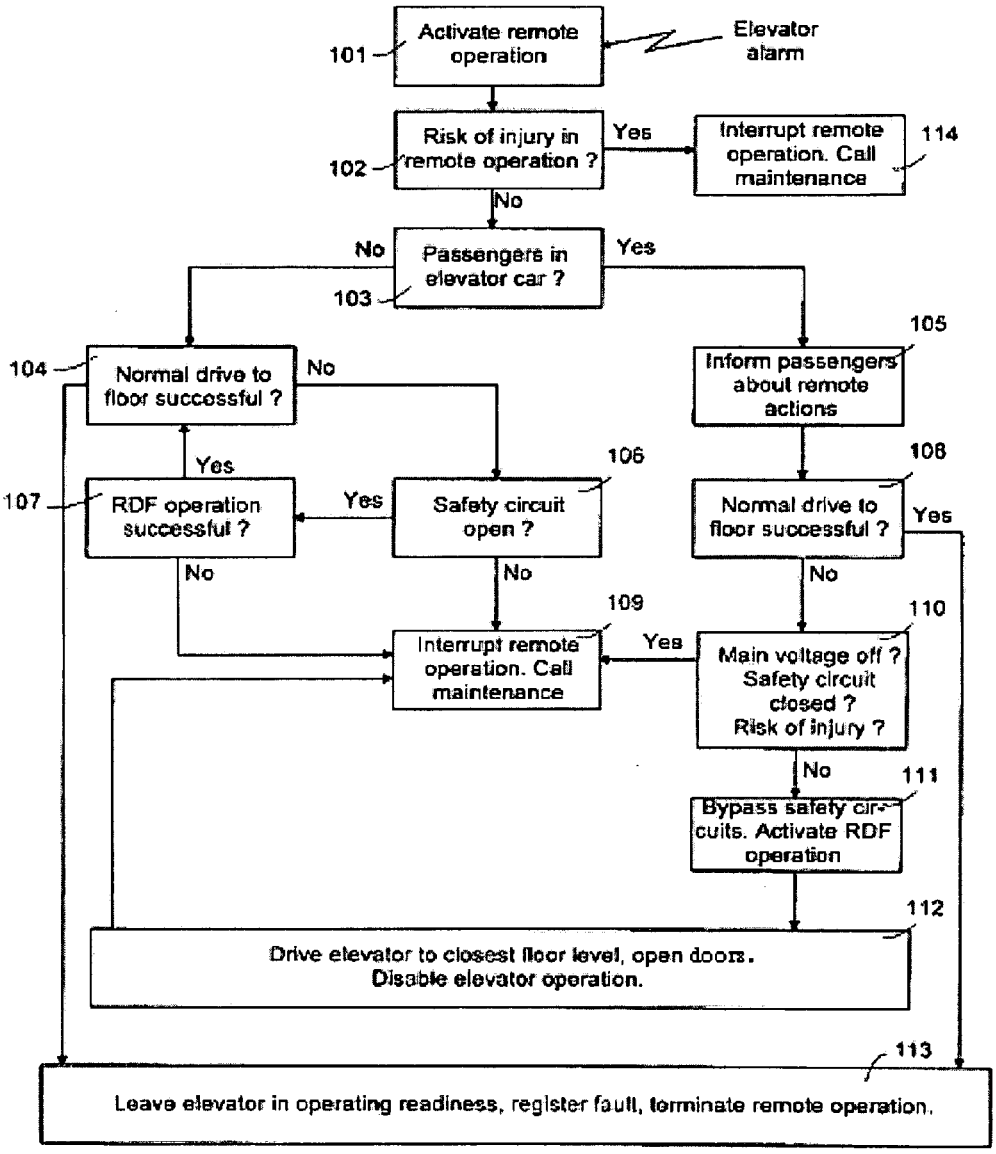

FIG. 2 presents a chain of inferences for the execution of control actions in the remote control system of the invention.

DETAILED DESCRIPTION OF THE INVENTION

FIG. 1 represents an arrangement according to the invention wherein the elevator car 1 of an elevator moves in an elevator shaft 3 between floors 1, 2 and 3. The hoistway doors are indicated by reference number 9 and the door of the elevator car by reference number 10. Reference number 5 indicates the elevator machine space, which may be a separate machine room and/or some other space arrangement comprised in the elevator, e.g. a space in the elevator shaft 3 ("elevator without machine room"). Placed in the machine space 5 is the elevator control system 14 and the elevator drive machine 13. The elevator is provided with monitoring cameras 2, installed in the machine space 5 as well as inside, on the top and at the bottom of the elevator car 1. The image information of the cameras 2 is transferred via data transfer means 11 to an interface unit 8. The interface unit 8 is connected to the elevator control unit 4 via data transfer means 12 and to a remote terminal 15 via data transfer means 16. Reference number 1*a* indicates communication means for guiding the passengers in the elevator car 1 in operational shutdown situations. The communication means may consist of e.g. audio and/or video terminals connected to the remote control system via a physical and/or wireless data transfer link (not shown in FIG. 1). Communication means 1*a* may also be provided elsewhere in the elevator, such as e.g. i.e. machine room, and/or in the elevator shaft. Reference number 17 indicates bypass cables for the shunting of safety circuits. The normal car and floor level cables of the elevator are not shown in FIG. 1.

Data transfer means 16 is preferably an Internet connection that allows the use of different encryption protocols for the set-up of a secure communication connection. The data transfer means 11, 12 and/or 16 may consist of physical data transfer means, or either partly or completely wireless data transfer means.

The remote elevator control system of the invention consists of the remote terminal 15, interface unit 8, monitoring cameras 2, data transfer means 11, 12 and 16 and the bypass cables 17. Moreover, illuminating means (not shown in FIG. 1) can be added to the system to illuminate the operating area of the elevator. The remote terminal may preferably be a PC computer or some other corresponding programmable terminal. The remote terminal comprises a display device 15*a* and control means 15*b* for the execution of elevator control functions. Reference number 15*c* indicates storage means for the storage of the image information for subsequent use. The remote terminal may be placed at a remote monitoring station or at the same property where the elevator or elevators to be controlled are located. The remote terminal may also be a portable terminal carried by a serviceman. The interface unit 8 may be a separate unit, preferably e.g. a PC computer, but it may also be integrated either partly or completely with the elevator control system or a group control system controlling a plurality of elevators. The interface unit 8 receives the camera information from the monitoring cameras 2 and transmits it to the remote terminal. The interface unit also receives and transmits elevator status data and/or control commands between the remote terminal and the elevator control system 14. Reference number 8*a* indicates a supervision unit, by means of which it is possible to limit the execution time of control commands entered from the remote terminal e.g. in the event of failure of the data transfer means. The bypass signals of the bypass cable 17 are controlled by the interface unit 8 and/or the elevator control system 14 as required by safety circuit bypass commands issued from the remote terminal. The safety circuits to be bypassed include e.g. drive machine holding brake, door lock circuit, door contactor circuit, emergency stop.

In a normal situation during elevator operation, the elevator car 1 moves between the floor levels 1,2,3, driven by the elevator drive machine 13 controlled by the control system 14. The control system receives calls from the call buttons on different floor levels and/or from the floor buttons in the elevator car or from the group control system controlling an elevator group of a plurality of elevators (the buttons and the group control system are not shown in FIG. 1). When the elevator car has arrived at a floor level 1, 2 or 3, the hoistway door 9 and the car door 10 are generally opened automatically to allow passengers to enter and/or exit from/to the floor. In operational shutdown situations, the control unit 14 sends the remote terminal information regarding the disturbance via data transfer means 12 and 16. The disturbance information automatically activates the remote terminal. The operator executes control actions from the remote terminal to allow the system to recover from the operational shutdown situation. If the operator is unable to carry out the required control actions from the remote terminal, then he will alarm the elevator maintenance personnel, calling them to the place of alarm.

FIG. 2 presents an example of the steps of remote operation according to the invention.

Step 101: The remote terminal receives alarm data from an elevator and automatically activates the control software required for remote control actions. The system notifies the operator as to which elevator has caused an alarm, giving the type of alarm and/or elevator status data, and displays the image information of the monitoring cameras on the display device of the remote terminal. The remote terminal requests the operator to enter a user name and/or password (operator authentication). Depending on the rights conferred on the user name, some of the control actions to be executed from the remote terminal may be disabled.

Step 102: The operator makes a decision as to the control actions required and infers from the image information of the monitoring cameras placed on the elevator and/or from the elevator status data whether the control actions to be entered from the remote terminal of the elevator involve a risk of injury to persons present in the operating area of the elevator. If a risk of injury exists, then the operator interrupts remote operation and calls authorized maintenance personnel to the place of alarm (step 102).

Step 103 and 105: The operator observes the image information of the monitoring camera placed inside the elevator car to determine whether passengers are present in the elevator car or not. If passengers are present in the elevator car, then the operator informs the passengers regarding remote control actions (step 5) and then starts the execution of a remote control action from the remote terminal (step 108). If no passengers are present in the elevator car, then the operator carries out control actions according to step 104.

Step 104: The operator drives the elevator (in normal operating mode) to one of the floor levels. If operation fails, then the operator checks the states of the safety circuits (step 106) from the remote terminal. If operation succeeds, then the operator leaves the elevator in operating readiness and terminates remote control (step 113).

Step 106: The operator checks the states of the elevator safety circuits from the remote terminal. If the safety circuits are "closed" (normal operating state), then the operator interrupts remote operation and calls authorized maintenance personnel to the place of alarm (step 109). If one of the safety circuits is "open", then the operator drives the elevator in RDF operating mode by bypassing safety circuits (step 107).

Step 107: The operator bypasses the safety circuits preventing RDF operation and enters an RDF operation command. The operator observes via the remote terminal, e.g. by the image information of the monitoring cameras, whether the elevator is moving in accordance with the RDF operation command. If the elevator implements the RDF operation command, then the operator releases the bypassed safety circuits and returns back to step 104. If the elevator does not implement the RDF operation command correctly, then the operator interrupts the remote operation and calls authorized maintenance personnel to the place of alarm (step 109).

Step 108: The operator starts normal operation from the remote terminal to drive the elevator to a floor level if the safety circuits do not prevent the operation. If the elevator can be successfully driven, then the operator terminates remote operation (step 113). If operation is unsuccessful, then the operator carries out an inference procedure according to step 110.

Step 110: The operator checks from the remote terminal whether the main voltage supply of the elevator has been disconnected, whether the elevator safety circuits are damaged, or whether a risk of injury exists when the elevator is operated. If one of these conditions is true, then the operator interrupts remote operation and calls authorized maintenance personnel to the place of alarm (step 109), otherwise the operator activates RDF operation (steps 111 and 112).

Step 109: The operator interrupts remote operation and calls authorized maintenance personnel to the place of alarm.

Steps 111 and 112: The operator bypasses the safety circuits preventing RDF operation, drives the elevator in RDF operating mode to the closest floor level, opens the hoistway door at the floor in question and/or the elevator car door from the remote terminal to let the passengers out of the elevator car. The operator disables operation of the elevator for the time being and calls authorized maintenance personnel to the place of alarm (step 109).

Step 113. The operator registers the failure situation, leaves the elevator in normal operating readiness and terminates remote operation.

It is obvious to the person skilled in the art that the invention is not limited to the embodiments described above, in which the invention has been described by way of example, but that many variations and different embodiments of the invention are possible within the scope of the inventive concept defined in the claims presented below.

The invention claimed is:

1. A method for executing elevator control actions from a remote terminal in a remote control system, characterized in that the method comprises:

imaging the operating area of the elevator by a number of monitoring cameras so that all persons present in the operating area of the elevator can be perceived from the image information of the monitoring cameras;

displaying the image information of the camera or cameras as well as elevator status data on the display device of the remote terminal;

selecting on the basis of the image information and/or elevator status data a control action to be executed;

estimating on the basis of the image information and/or elevator status data whether the execution of the selected control action involves a risk of injury; and starting the execution of the control action from the remote terminal if the estimation thus made indicates that the control action involves no risk of injury.

2. A method according to claim 1, wherein the control actions are executed in an operational shutdown situation of the elevator.

3. A method according to claim 1, wherein the method further comprising:

observing the execution of the control action by the aid of the image information and/or elevator status data via the display device of the remote terminal during the execution of the control action; and interrupting the execution of the control action from the remote terminal if a risk of injury is detected during the execution of the control action.

4. A method according to claim 1, wherein the monitoring cameras whose image information is displayed simultaneously on the display device of the remote terminal are selected.

5. A method according to claim 1, wherein at least one of the elevator safety circuits is bypassed from the remote terminal of the remote control system.

6. A method according to claim 1, wherein the control actions are executed in order to rescue elevator passengers from an elevator car.

7. A method according to claim 1, wherein at least one of the following control actions are executed from the remote terminal of the remote control system:

driving the elevator in normal operating mode to a floor level;

stopping the elevator;

opening and/or closing the hoistway door;

opening and/or closing the elevator car door;

opening and/or closing the brake of the elevator drive machine;

driving the elevator in RDF operating mode.

8. A method according to claim 1, wherein the activation of one or more control actions is allowed via authentication and a secure data communication link.

9. A method according to claim 1, wherein the execution time of one or more control actions started from the remote terminal is limited.

10. A method according to claim 1, wherein the image information of one or more monitoring cameras is also transmitted to a guarding post of the property containing the elevator.

11. A method according to claim 1, wherein two or more elevators are controlled from one remote terminal.

12. A method according to claim 1, wherein the operating area of the elevator is illuminated to improve the image information.

13. A method according to claim 1, wherein the image information of one or more monitoring cameras is stored for subsequent analysis.

14. A remote elevator control system, comprising at least:

a remote terminal;

a number of monitoring cameras; and interface and data transfer means for the transmission of the image information of the monitoring cameras as well as elevator status data and/or control commands between the elevator and the remote terminal, wherein the monitoring cameras are so directed that their combined image area substantially covers the operating area of the elevator, the remote terminal is provided with a display device for the display of image information and/or elevator status data, and the remote terminal contains means for starting elevator control functions.

15. A remote control system according to claim 14, wherein the remote control system additionally comprises means for bypassing from the remote terminal one or more safety circuits comprised in the elevator.

16. A remote control system according to claim 14, wherein the system additionally comprises means for limiting the execution time of control functions started from the remote terminal.

17. A remote control system according to claim 14, wherein the remote control system additionally comprises data transfer means for the transmission of the image information of one or more monitoring cameras to a guarding post of the property containing the elevator.

18. A remote control system according to claim 14, wherein the remote terminal of the remote control system can be connected to two or more elevators.

19. A remote control system according to claim 14, wherein the remote control system additionally comprises means for illuminating the operating area of the elevator.

20. A remote control system according to claim 14, wherein the remote control system additionally comprises means for storing the camera information of one or more monitoring cameras.

* * * * *